US006603954B1

(12) United States Patent
Zoltner et al.

(10) Patent No.: US 6,603,954 B1
(45) Date of Patent: Aug. 5, 2003

(54) POST SLIT DECURLER AND SHEET STACKER DEVICE

(75) Inventors: John D. Zoltner, Fairport, NY (US); Gary A. Kelpin, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/293,165

(22) Filed: Apr. 16, 1999

Related U.S. Application Data

(63) Continuation-in-part of application No. 08/784,635, filed on Jan. 21, 1997, now abandoned.

(51) Int. Cl.[7] ..... B65H 29/70; G03G 21/00

(52) U.S. Cl. ..... 399/405; 399/406; 83/109; 83/167; 162/271; 271/188; 271/209

(58) Field of Search ..... 83/23, 29, 78, 83/84, 86, 109, 112, 167; 399/361, 405, 406; 162/197, 270, 271

(56) References Cited

U.S. PATENT DOCUMENTS

| | | | | | |
|---|---|---|---|---|---|
| 1,150,608 | A | * | 8/1915 | Lundeberg | 162/271 |
| 2,038,568 | A | * | 4/1936 | Jagger | 101/133 |
| 4,571,054 | A | * | 2/1986 | Bowler, Jr. | 399/406 X |
| 4,652,110 | A | * | 3/1987 | Sato et al. | 399/406 |
| 4,977,432 | A | * | 12/1990 | Coombs et al. | 399/406 X |
| 5,066,984 | A | * | 11/1991 | Coombs | 399/406 |
| 5,515,152 | A | * | 5/1996 | Kuo | 399/406 |
| 5,553,528 | A | | 9/1996 | Zoltner | 83/443 |
| 5,565,971 | A | * | 10/1996 | Kuo et al. | 399/406 |

* cited by examiner

*Primary Examiner*—Clark F. Dexter
(74) *Attorney, Agent, or Firm*—William A. Henry, II; Philip E. Blair

(57) ABSTRACT

A portable, post slit decurler and high capacity stacker module for use with a machine, such as, a desktop page printer, includes a decurler that decurls prints after they have been slit into thirds, halves, or whole prints. The post slit decurler and high capacity stacker module sits in a receiving tray of a copier/printer and is separately powered or "hard wired" into the copier/printer.

4 Claims, 3 Drawing Sheets

POST SLIT DECURLER AND SHEET STACKER DEVICE

RELATED APPLICATIONS

This is a continuation-in-part of application Ser. No. 08/784,635, filed Jan. 21, 1997, now abandoned.

FIELD OF THE INVENTION

The present invention relates to a slitter suitable for cutting sheets which are output from a desktop-size printing machine.

Generally, commercially available electrophotographic desk-top printers, as disclosed in U.S. Pat. No. 5,553,528 which are available at low cost are designed to output letter size pages. Of course, these printers have been used to make documents much smaller than a full-page size, such as, from about one-third to one-half the size of a full page in order to produce post cards. One problem with producing post cards with this method is the curl that results and this is especially so with the use of 90 pound sheets. This curl can impede high speed zip code readers/sorters and other machines and create jams. It would therefore be desirable to provide, as an add-on to a standard design of an electrophotographic desk-top printer, a device which can take full sheet output from the printer and cut each sheet into post card size without the resulting curl. One type of device which performs this cutting is called a "slitter."

A slitter is a device which accepts a sheet in a process direction, and cuts the sheet being fed therethrough in a direction parallel to the process direction. Various designs of such slitters are well-known in the art, and include such early patents as U.S. Pat. Nos. 244,845; 325,812; 391,750; 393,535; 416,826; and 3,122,040. U.S. Pat. No. 4,559,855, or U.S. Pat No. 5,049,929, both assigned to the assignee hereof, can be seen as disclosing "dedicated" slitters, wherein the function of the slitter is built into a relatively large-scale

SUMMARY OF THE INVENTION

According to one aspect of the present invention, there is provided a removable, portable, post slit decurler and high capacity stacker module for use with cut sheets emitted in an output direction toward a slit output nip of a printing machine after they have been slit and with a predetermined curl. The removable, portable, post slit decurler and high capacity stacker module includes a decurler device; a slit output nip downstream of the decurler device; a deflection baffle positioned between the decurler device and the slit output nip for effecting a reverse curl in the cut sheets to thereby straighten them; and a receiver for receiving and stacking the cut sheets.

DETAILED SPECIFICATION

Figure 1:
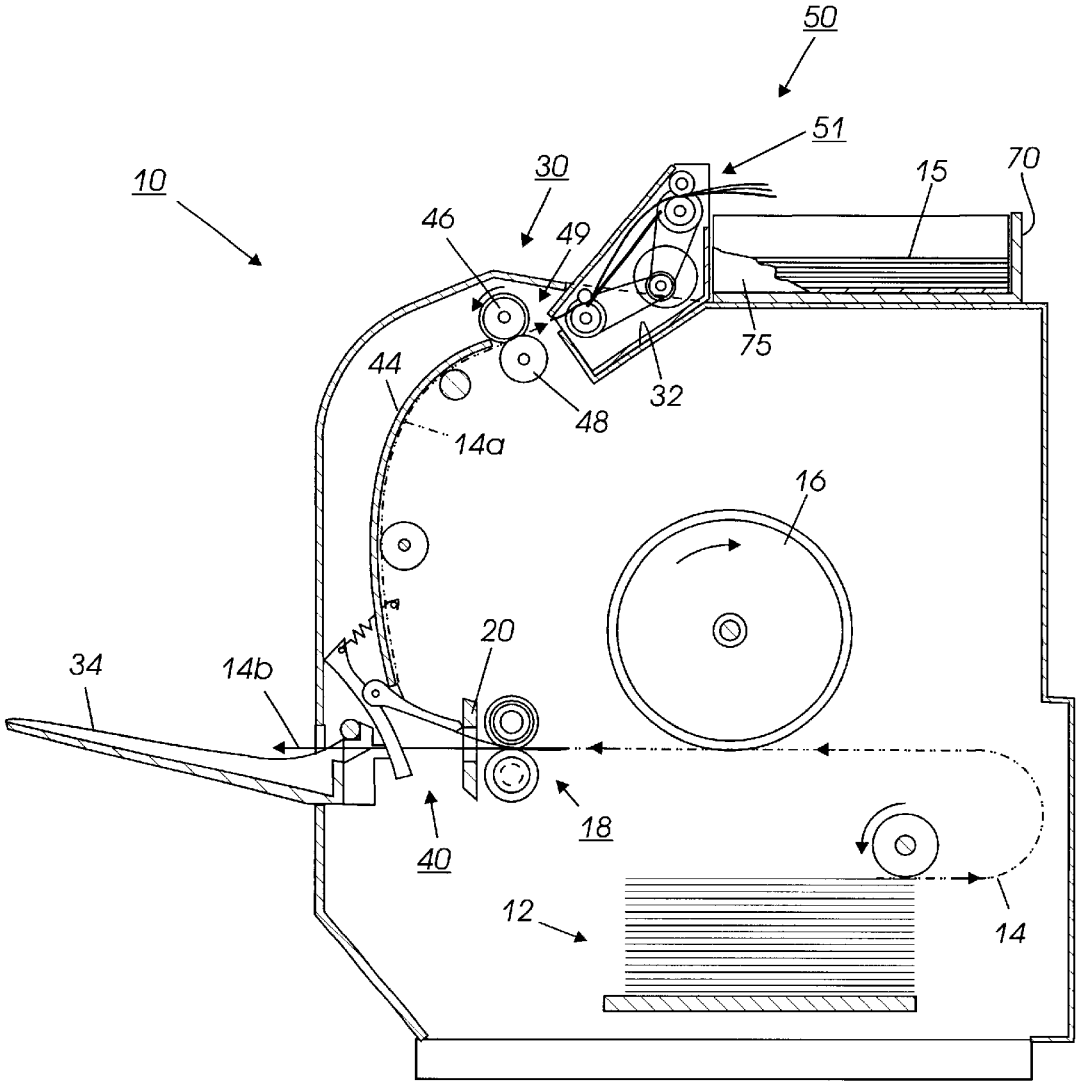
FIG. 1 is an enlarged, simplified, elevational view showing the basic portions of a desk-top printing machine, with the portions thereof relevant to the present invention.

FIG. 1 shows the basic elements of a desktop-size page printer of a general design known in the art, incorporating a conventional slitter. The printing machine, generally indicated as 10, includes, among other image-forming components, a paper supply 12, from which is drawn sheets one at a time for the creation of images thereon. A sheet withdrawn from paper supply 12 is passed through path 14 past an image forming device in the form of, for example, a photoreceptor 16, the function of which is familiar to those skilled in the art of electrophotography. It will be apparent that the photoreceptor 16 could be replaced by, for example, an ink-jet printhead or other image forming device which creates images on a selected sheet in accordance with digital image data fed thereto. Also, a "printing machine" as recited in the claims could also refer to a light-lens copier. As shown in FIG. 1, the sheets are passed through a fuser 18 useful in electrophotographic printing, and then pushed through what is generally referred to as an output slot 20, which is here intended to mean simply the point along the paper path 14 after which the printed sheet would generally be accessible to a user.

Also shown in the printing machine of FIG. 1 is a slitter generally indicated as 30. Once the desired image is formed on the page-size (such as 8½×11 inches) sheet, the sheet can be selectably cut into smaller sheets, such as to form individual post cards, or to form checks and stubs, or the like as would be desired by a user. As used in the specification and claims herein, the word "cutting" and the function of a "slitter" shall also be intended to include all variations of cutting, such as perforating to create separable portions of a sheet, or even embossing and debossing sheets passing therethrough. It will be noted that a portion of the paper path 14, here indicated as 14*a*, passes from output slot 20 and through the slitter 30, with the cut sheet being deposited in a top output tray 32. Alternately, sheets which are emitted from output slot 20 may be selectably diverted from slitter 30 by conventionally controlled two positioning diverter 40 as disclosed in U.S. Pat. No. 5,553,528 and sent along path 14*b* to land inside output tray 34.

Figure 2:
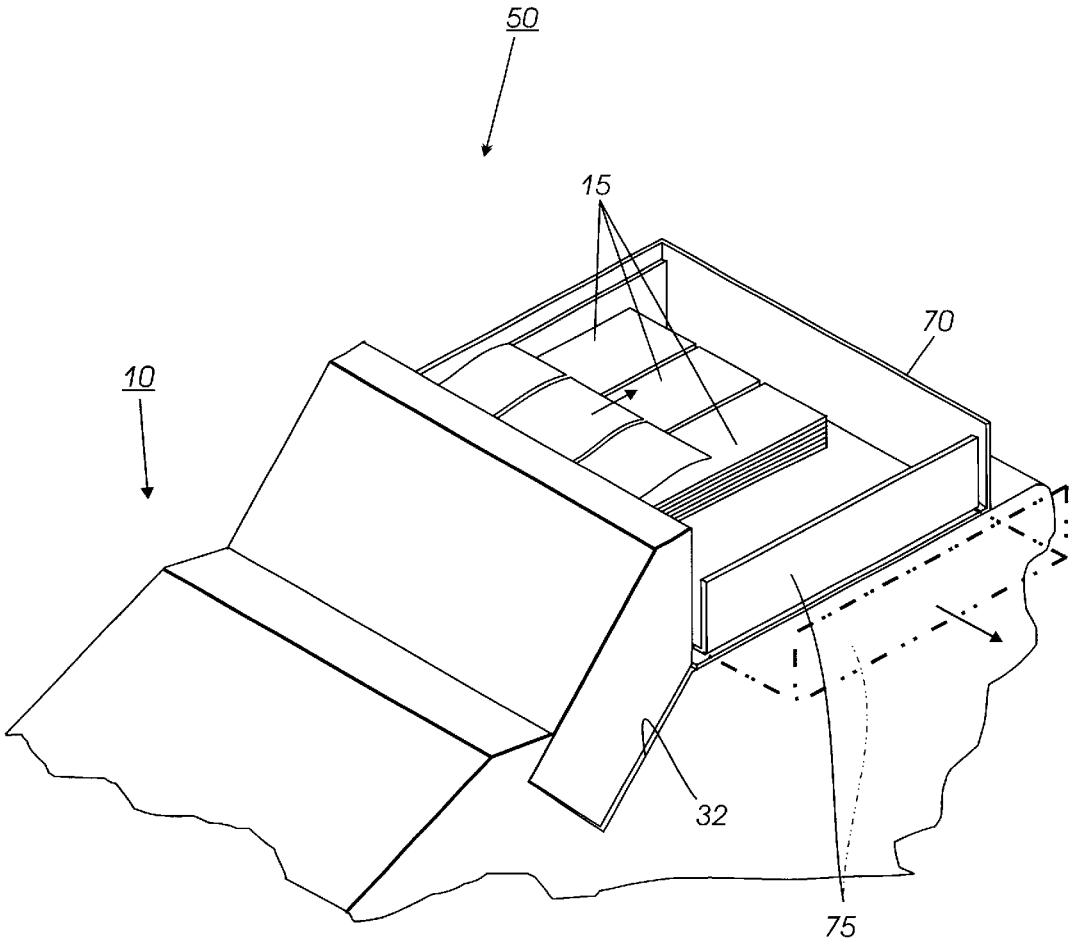
FIG. 2 is an enlarged, partial perspective view showing the post slit decurler and high capacity stacker module according to the present invention positioned within the receiving tray of the printer of FIG. 1.

FIG. 2 is a partial perspective view showing the post slit decurler and high capacity stacker module 50 according to the present invention positioned within stationary tray 32 of the printer of FIG. 1. That ordinarily would receive output from printer 10 if the post slit decurler and high capacity stacker is not positioned therein. As shown, three slit 90 pound cardstock post cards 15 are emerging decurled into high capacity receiving tray 70 that is positioned within tray 32 of printer 10. At the end of a run, the cardstock is removed from receiving tray 70 by use of slidably removable drawer 75. Drawer 75 is adapted to slide orthogonally to the direction of sheets or cardstock coming into tray 70.

When the diverter 40 in FIG. 1 is urged by conventional means to remain in a first and down position, a sheet coming through output slot 20 it long paper path 14 is guided over the diverter 40, and caused to move along a directing plate here indicated as 44. Although directing plate 44 is here illustrated as a solid curved plate, it will be apparent that the function of directing plate could be performed by, for example, a set of narrow skids or fins, or a set of rollers, or a device applying an air pressure or suction to the sheet, all with the intended function of directing the sheet along path 14*a* to be properly fed into slitter 30. The slitter generally indicated as 30 includes a first roll 46 and a second roll 48 forming a nip 49 therebetween. As illustrated in FIG. 1, different portions of rollers 46 and 48 may overlap slightly in a manner which is familiar in the art of slitters.

Figure 3:
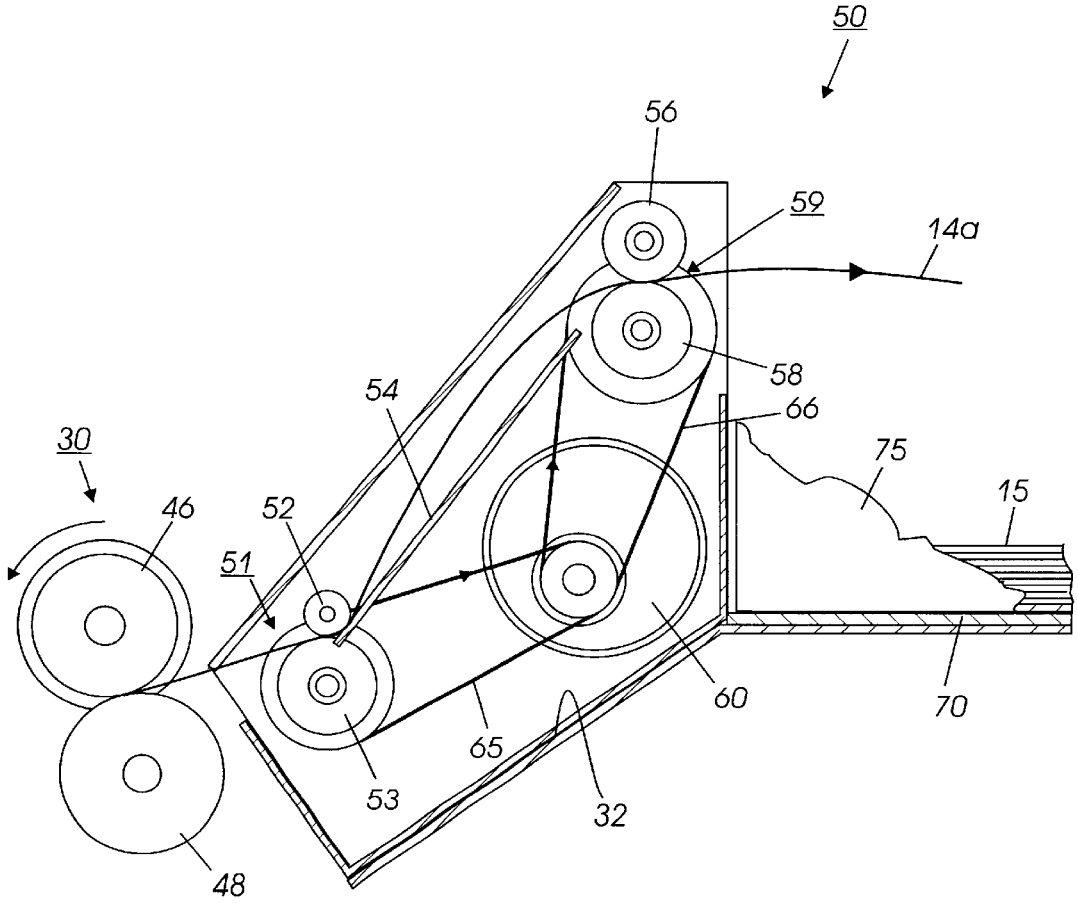
FIG. 3 is an enlarged, simplified, partial elevational view showing, in detail, the post slit decurler and high capacity stacker module of FIG. 2.

FIG. 3 shows a partial, detailed view of the post slit decurler and high capacity stacker module 50 that in accordance with the present invention solves the problem of curled 90 pound index stock that is used to create post cards 15. The uniqueness of the decurler and stacker module 50 arises from the fact that prints exiting printer 10 are decurled in an external, portable module which sits in the printer's sheet output receiving tray and the fact that the prints are decurled after the prints are slit into thirds or halves, or left whole. A decurler apparatus 51 receives cut or slit sheets from slitter 30 and decurls them before they fall into tray 70. Decurler apparatus 51 includes a driven shaft with multiple 15 mm diameter rubber rolls 52 which feed the 90 pound cardstock between its circumference and that of a 6 mm diameter metal idler roll 53. The cardstock, now slit into as many as three pieces, is then deflected against a deflector or baffle 54, preferably made of sheetmetal, but could be made of plastic or other materials. Baffle 54 is positioned in close proximity to and at an acute angle with respect to a horizontal plane through the nip formed between rolls 52 and 53 and as a result of the interaction of sheets hitting baffle 54 and the baffle's closeness to the 6 mm metal idler roll, a reverse curl is effected in the cardstock. Stress on the sheets at the deflector must surpass the yield point. The bending of the sheets into the deflector causes a reverse curling effect and decurls the sheets. A slit output nip 59 formed between rolls 56 and 58 is positioned downstream of the decurler 51 and deflector 54 and positioned such that sheets forwarded by decurler 51 will buckle into the slit output nip 59. A motor 60 conventionally drives decurler 51 and the slit output nip 59 through belts 65 and 66.

The slit output nip formed between rolls 56 and 58 is elevated a predetermined distance above slidably removable drawer 75 of high capacity receiving tray 70 to maximize stacking. Drawer 75 is removed from high capacity receiving tray 70 when emptying is required. Removable and portable post slit decurler and high capacity stacking module 50 is an accessory and simply sits in the top of tray 32 and plugs into a 24 volt adapter from a wall outlet, but can easily be 'hard wired' into printer 10, if desired.

According to a preferred embodiment of the present invention, a portable post slit decurler and high capacity stacker module is disclosed that includes a decurler in the form of a 6 mm shaft driven by multiple rubber rolls which drive sheets exiting the decurler into a deflector placed at a sharp angle at the sheet exit point from the decurler. Bending of the sheets into the deflector causes a reverse curling effect and decurls the sheets before they are conveyed into a receiver tray.

While the invention has been described with reference to the structure disclosed, it is not confined to the details set forth, but is intended to cover such modifications or changes as may come within the scope of the following claims.

What is desired to be secured by Letters Patent is:

1. A portable post slit, decurler and sheet stacker device for image forming apparatus, comprising:

a first pair of decurling rolls forming a slit input nip for receiving curled sheets therethrough;

a second pair of decurling rolls forming a slit output nip;

a deflection baffle positioned between said first and second pairs of decurling rolls forming a decurling nip with one of said first pair of decurling rolls, wherein bending of curled sheets passing therethrough causes a reverse curling effect to be imparted to said curled sheets, said deflection baffle positioned at an acute angle with a horizontal plane running between said first pair of decurling rolls, said horizontal plane being orthogonal to a line intersecting center points of each of said first pair of decurling rolls; and a receiving tray in structural communication with said slit output nip for receiving and stacking decurled sheets.

2. The device of claim 1, wherein said receiving tray includes a slidably removable drawer which slides into and is removable from said receiving tray for emptying of said decurled sheets from said drawer.

3. An image forming apparatus having an interior portion thereof, comprising:

image generating means positioned within said interior portion of said apparatus for creating an image on a sheet, and transport means for transporting said sheet from said image generating means through said internal portion of said apparatus to an exterior portion of said apparatus;

a stationary tray included as an integral part of said exterior portion of said apparatus and having a surface for receiving said sheet from said transport means; and a removable, portable post slit decurler and sheet stacker device mounted on said surface of said stationary tray for receiving said sheets after they exit said interior portion of said apparatus, said device comprising:

a first pair of decurling rolls forming a slit input nip for receiving curled sheets therethrough;

a second pair of decurling rolls forming a slit output nip;

a deflection baffle positioned between said first and second pairs of decurling rolls forming a decurling nip with one of said first pair of decurling rolls, wherein bending of curled sheets passing therethrough causes a reverse curling effect to be imparted to said curled sheets, said deflection baffle positioned at an acute angle with a horizontal plane running between said first pair of decurling rolls, said horizontal plane being orthogonal to a line intersecting center points of each of said first pair of decurling rolls; and a receiving tray in structural communication with said slit output nip for receiving and stacking decurled sheets.

4. The apparatus of claim 3, wherein said receiving tray includes a slidably removable drawer which slides into and is removable from said receiving tray for emptying of said decurled sheets from said drawer.

* * * * *